US007905298B2

(12) United States Patent
Coppola

(10) Patent No.: US 7,905,298 B2
(45) **Date of Patent: *Mar. 15, 2011**

(54) SYSTEMS AND METHODS EMPLOYING A VARIABLE ANGLE GUIDE FOR A DRILL

(76) Inventor: Richard Coppola, Langhorne, PA (US)

( * ) Notice: Subject to any disclaimer, the term of this patent is extended or adjusted under 35 U.S.C. 154(b) by 331 days.

This patent is subject to a terminal disclaimer.

(21) Appl. No.: 12/025,041

(22) Filed: Feb. 3, 2008

(65) Prior Publication Data

US 2008/0115975 A1 May 22, 2008

Related U.S. Application Data

(63) Continuation-in-part of application No. 11/050,976, filed on Feb. 4, 2005, now Pat. No. 7,438,502.

(51) Int. Cl.
*E21B 7/136* (2006.01)

(52) U.S. Cl. ..... 175/10

(58) Field of Classification Search ..... 175/5, 7, 175/9, 10

See application file for complete search history.

(56) References Cited

U.S. PATENT DOCUMENTS

| | | | | |
|---|---|---|---|---|
| 298,251 | A * | 5/1884 | Sterling | 175/10 |
| 920,031 | A * | 4/1909 | Cuthbert | 175/5 |
| 1,517,556 | A * | 12/1924 | Grant | 175/10 |
| 3,451,493 | A * | 6/1969 | Storm | 175/9 |
| 3,650,339 | A * | 3/1972 | Selfe et al. | 175/5 |
| 3,874,462 | A * | 4/1975 | Harms et al. | 175/5 |
| 3,933,108 | A * | 1/1976 | Baugh | 175/7 |
| 7,438,502 | B2 * | 10/2008 | Coppola | 405/158 |

* cited by examiner

*Primary Examiner* — John Kreck

(57) ABSTRACT

Disclosed are systems and methods for drilling in an environment having a fluid and a bed. The method includes positioning a platform such that the fluid is between the platform and the bed; and assembling a guide, the assembled guide being straight. The method subsequently acts to place the guide such that the guide is supported by the platform, and a major length of the guide and a normal to the bed defines an angle, the angle being substantially greater than 0. Thus, the positioned guide allows for sending a variable angle drill inside the guide, from the platform into the bed.

20 Claims, 3 Drawing Sheets

SYSTEMS AND METHODS EMPLOYING A VARIABLE ANGLE GUIDE FOR A DRILL

This Application is a continuation-in-part of U.S. application Ser. No. 11/050,976 of RICHARD COPPOLA filed Feb. 4, 2005 for TELESCOPING UNDERWATER GUIDE, the contents of which are herein incorporated by reference. U.S. application Ser. No. 11/050,976 claims the benefit of U.S. Application Ser. No. 60/547,442 of RICHARD COPPOLA filed Feb. 26, 2004 for TELESCOPING UNDERWATER GUIDE.

BACKGROUND OF THE INVENTION

1. Field of the Invention

The present invention relates to an independently segmental, multi-segmental, and sectional telescoping device for guiding elongated rigid and flexible objects such as directional, variable angle drill, bore and such machine and other stems, rods, piping, tubing, hoses, cables, lines and other similar elongated structures through atmospheric, vacuum, partial vacuum, semi-submerged, and completely submerged underwater environments operating through the atmosphere, vacuum, partial vacuum, fluid, fluid and water columns in man made containment vessels, artificial and natural bodies of water such as lakes, streams, rivers, coastal waters, oceans and into and through such waterway and other bottom materials and without environmental impact.

More specifically, it relates to a means for guiding directional, variable angle drill, bore, and such machine, equipment and rigid and flexible material stems, rods, piping, tubing, hoses, cables, lines and other similar structures underwater through varying water column depths at variable longitudinal lengths and angles by creating an infinitely adjustable independently segmented and telescoping, dynamic and lockable telescoping guide segments thereby infinitely adjusting in static, dynamic and hybrid functions to the distance between fixed, variable elevation, floating, or submerged work surfaces, and surface machinery, equipment and materials and the waterway bottom and other materials. Its installation and operational length and operational angle is infinitely adjustable. Its optionally incorporated integrated floatation and buoyancy in water is infinitely adjustable per segment or over its entire length. Its structural width is adjustable per segment or over its entire length thereby permitting the handling and installation of various dimension drill, bore, machine, stems, rods, piping, tubing, hoses, cables, lines and other similar structures in semi-submerged and submerged underwater applications into and through waterway bottom and other materials without environmental impact.

2. Description of Related Art

Variable angle bore, drill stems and other type pipe, rod and elongated objects are limited and prevented from penetration and installation through the atmosphere, vacuum, fluid, and water columns into and through waterway and other bottom materials due to absence of a segmented and telescoping underwater guide providing infinitely adjustable dynamic and static longitudinal adjustment functions and operation while providing variable structural width and lateral support for bore, drills, stems rods, piping, tubing, hoses, cables, lines and other elongated objects and similar structures in semi-submerged and submerged underwater applications and absence of adjustability to accommodate varying water column depths between the water surface and waterway bottom and other material elevation(s), as well as other clear dimensional applications and absence of the ability to sectionally and telescopically adjust the guide length statically, dynamically and in hybrid mode in single, and multi-sectional length, sectional width, and its angle to the waterway bed and other material elevations and absence of a system and method of handling and installing various dimension drill, bore, machine, stems, rods, piping, tubing, hoses, cables, lines and other similar structures in semi-submerged and submerged underwater applications while eliminating environmental impact. For these reasons, there is a need in the art for a new system to permit penetrations through varying water column depths, into and through waterway bed and other materials at various angles in atmospheric, submerged, semi-submerged and other applications which overcomes the above disadvantages and limitations described.

SUMMARY OF THE INVENTION

According to an aspect of the present invention, there is a method for drilling in an environment having a fluid and a bed. The method comprises positioning a platform such that the fluid is between the platform and the bed; assembling a guide, the assembled guide being straight; placing the guide such that the guide is supported by the platform, and a major length of the guide and a normal to the bed defines an angle, the angle being greater than 0; and sending a variable angle drill inside the guide, from the platform into the bed.

According to another aspect of the present invention, there is a method for drilling in an environment having a fluid and a bed. The method comprises positioning a support such that the fluid is between the support and the bed; assembling a guide, the assembled guide being straight; placing the guide such that the guide is supported by the support, and a major length of the guide and a normal to the bed defines an angle; changing the angle; and sending a variable angle drill inside the guide, from the support into the bed.

DETAILED DESCRIPTION OF EXEMPLARY EMBODIMENTS

In the absence of prior art and in order to eliminate prior restrictions and limitations, the exemplary embodiment has been devised for guiding, orienting, directing and installing elongated structures such as directional and variable angle machine, bore, drill, equipment, materials, stems, rods, piping, tubing, hoses, cables, lines and other elongated structures being not submerged, semi-submerged and/or fully submerged underwater and through varying air and water column distances in atmospheric, vacuum, partial vacuum, lakes, streams, rivers, coastal waters, oceans and through waterway bottom and other materials. The exemplary embodiment has been devised as a means for inserting, guiding and installing directional, variable angle drill, bore, and such machine, equipment and material stems, rods, piping, tubing, hoses, cables, lines and other elongated structures at variable angles by creating a segmented, incremental, infinitely adjustable and telescoping, lockable, static, and telescoping guide being infinitely adjustable in static, dynamic and hybrid states in length, dimension, and angle between stationary, fixed, moving, variable elevation, floating work surfaces, machinery, equipment, materials to and through waterway and marine bottom and other materials. Its longitudinal length and operational angle is infinitely adjustable. Its optionally attached integrated floatation and buoyancy vessels are either segmentally fixed or infinitely adjustable per segment and over the guide assembly's entire length. Its structural width is adjustable per segment or over its entire length thereby permitting the handling and installation of various dimension drill, bore, machine, stems, rods, piping, tubing, hoses, cables, lines and other similar elongated structures being not submerged, semi-submerged and/or fully submerged underwater and through varying air and water column distances in atmospheric, vacuum, partial vacuum, lakes, streams, rivers, coastal waters, oceans and through waterway bottom and other materials without environmental impact.

Figure 1:
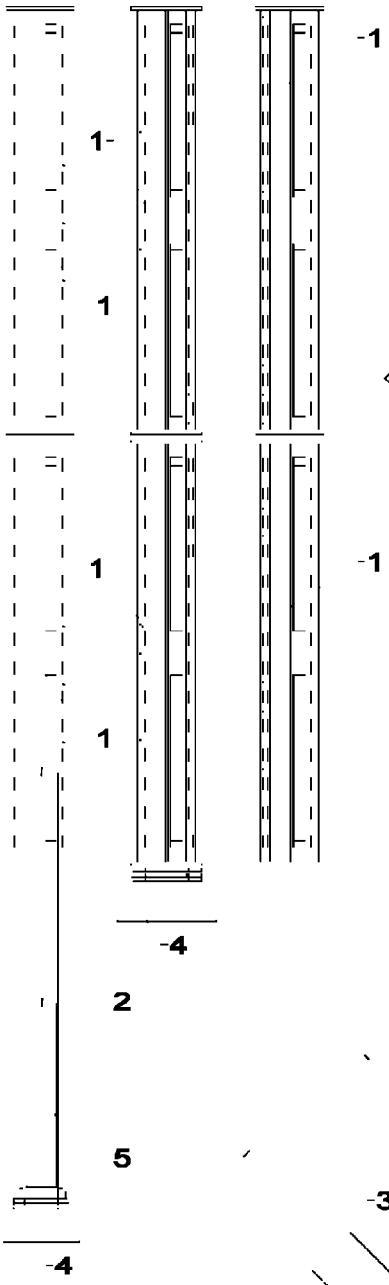
FIG. 1 is a general illustration matrix of the rigid segment, and telescoping underwater guide segment assembly.

FIG. 1 is a general illustration matrix of the rigid segment, and telescoping underwater guide segment assembly. One or more segments may be used as shown. FIG. 1 includes three profile views of two rigid guide segments coupled together in three different configurations thereby providing structural and lateral support for the elongated objects placed within the guide to be installed, and if desired, the inner-friction/spacer sleeve (5). The illustration to the left shows one rigid guide segment (1) and one telescoping guide segment (1,2) comprised of one rigid guide segment and a telescoping element (2) slidable with infinite adjustment, incremented, or selected locking points. Also shown is an angled, flare, or cone end (4) optionally installed at the end of the telescoping segment.

The illustration at center shows two rigid guide segments (1) oriented as coupled with an optionally installed angled, flare, or cone end (4) secured directly to the end of the rigid segment. The illustration to the right shows two rigid guide segments (1) oriented as coupled without the telescoping guide segment or angled, flare, or cone end installed.

Referring to FIG. 1, there is a general illustration matrix of the rigid segment, and telescoping underwater guide segment assembly. One or more segments may be used as shown. FIG. 1 includes three profile views of two rigid guide segments coupled together in three different configurations thereby providing structural and lateral support for the elongated objects placed within the guide to be installed, and if desired, the inner-friction/spacer sleeve (5). The illustration to the left shows one rigid guide segment (1) and one telescoping guide segment (1,2) comprised of one rigid guide segment and a telescoping element (2) slidable with infinite adjustment, incremented, or selected locking points. Also shown is an angled, flare, or cone end (4) optionally installed at the end of the telescoping segment. The illustration at center shows two rigid guide segments (1) oriented as coupled with an optionally installed angled, flare, or cone end (4) secured directly to the end of the rigid segment. The illustration to the right shows two rigid guide segments (1) oriented as coupled without the telescoping guide segment or angled, flare, or cone end installed.

Figure 2:
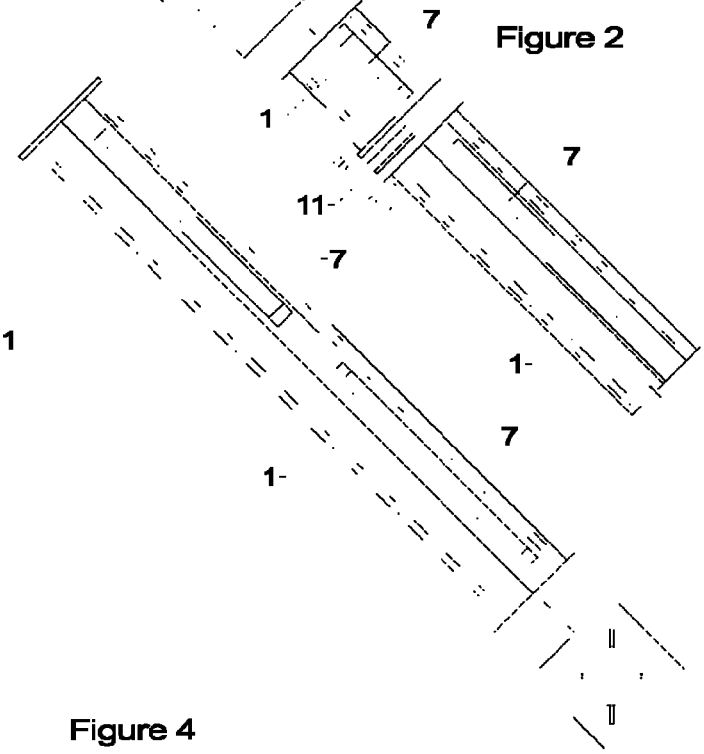
FIG. 2 is a general illustration matrix of different length rigid guide segment.

FIG. 2 is a general illustration matrix of different length rigid guide segment, (1) end flanges (6) and an optionally installed base plate (9) with mounting brackets (10) for securing hardware and machinery to the base plate. Connecting hardware (11) comprised of bolting, pinning, banding, clipping and such methods for securing and coupling guide segments is shown. The lower section is a profile view of a rigid guide segment showing the binding block (7) which is secured to the rigid guide segment for the locking of the telescoping element in a fixed position or adjusted to permit dynamic extension and retraction of the telescoping segment and the underwater guide assembly.

Referring to FIG. 2, there is a general illustration matrix of different length rigid guide segment, (1) end flanges (6) and an optionally installed base plate (9) with mounting brackets (10) for securing hardware and machinery to the base plate. Connecting hardware (11) comprised of bolting, pinning, banding, clipping and such methods for securing and coupling guide segments is shown. The lower section is a profile view of a rigid guide segment showing the binding block (7) which is secured to the rigid guide segment for the locking of the telescoping element in a fixed position or adjusted to permit dynamic extension and retraction of the telescoping segment and the underwater guide assembly.

Figure 3:
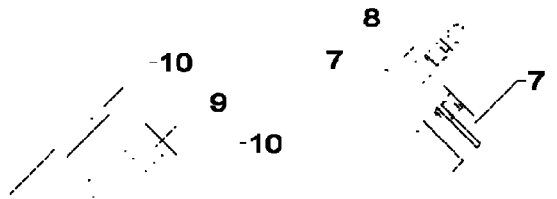
FIG. 3 is a detailed plan view (lower left) and elevation view (upper view) of the optionally used binding block.

FIG. 3 is a detailed plan view (lower left) and elevation view (upper view) of the optionally used binding block (7) components comprising of the threaded block body (7), and binding hardware consisting of set screws thereby locking or dynamically controlling the telescoping guide segment (2).

Figure 4:
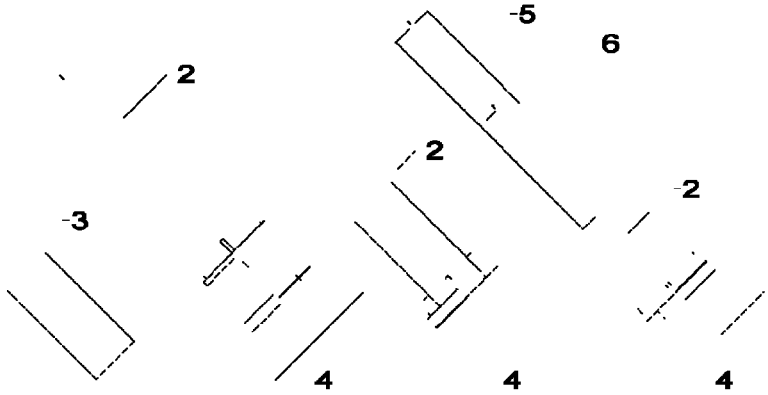
FIG. 4 is a general illustration matrix of the telescoping guide segments.

FIG. 4 is a general illustration matrix of the telescoping guide segments. The illustration at left is a telescoping segment without flanges (3) installed for coupling an angled, flare, or cone end (4) which may optionally be used as an intermediate telescoping segment within the underwater guide assemble shown in FIG. 9 The illustration at center left is a telescoping section with a flange installed for mounting an angled, flare, or cone end (4) as oriented for connection as shown. The illustration at center right is a telescoping segment (2) with the angled, flare, cone end (4) installed. The illustration at right is a telescoping segment (2) with the angled, flare, cone end (4) installed with an optionally installed inner-friction/spacer sleeve (5).

Figure 9:
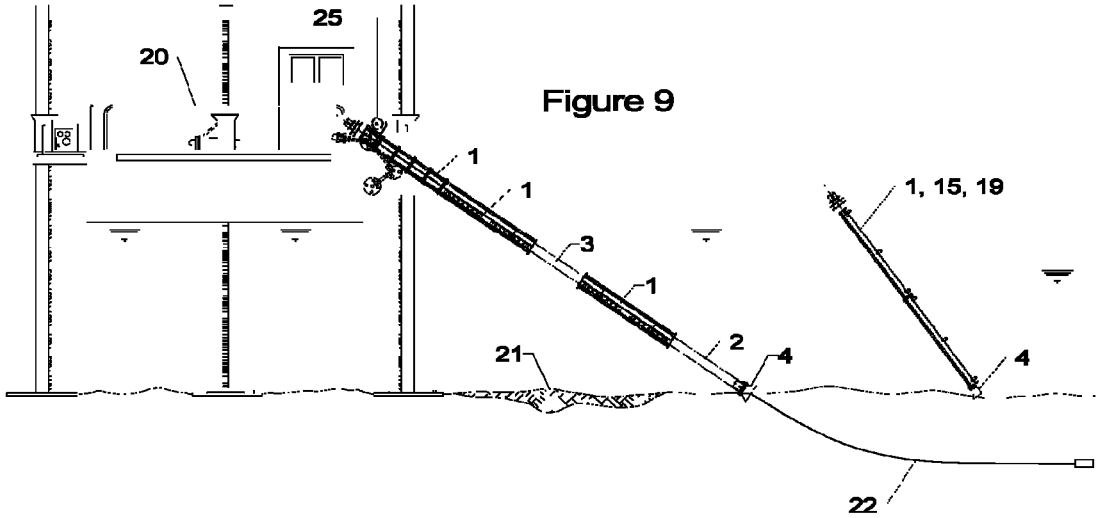
FIG. 9 is a profile view of a variant work surface.

Referring to FIG. 4, the illustration at left is a telescoping section without flanges (3) installed for coupling an angled, flare, or cone end (4) which may optionally be used as an intermediate telescoping segment within the underwater guide assemble shown in FIG. 9 The illustration at center left is a telescoping section with a flange installed for mounting an angled, flare, or cone end (4) as oriented for connection as shown. The illustration at center right is a telescoping segment (2) with the angled, flare, cone end (4) installed. The illustration at right is a telescoping segment (2) with the angled, flare, cone end (4) installed.

Figure 5:
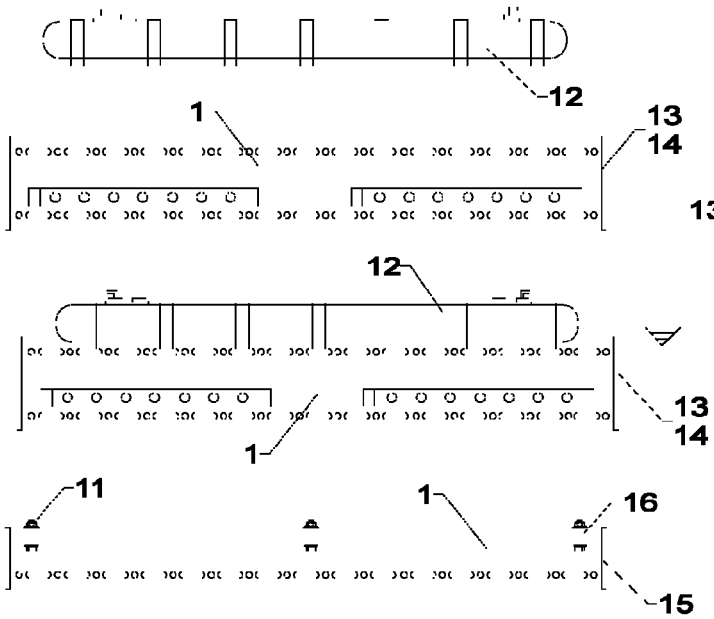
FIG. 5 is a general illustration matrix of the telescoping guide segments.

FIG. 5 is a general illustration matrix of the telescoping guide segments. The top illustration is a profile view of the optionally installed external floatation vessel (12) composed of rigid, solid, semisolid, hollow, static, flexible, or inflatable vessel materials for in-water floating assembly of the underwater guide assembly. The external floatation vessel is secured to the underwater guide segments by rigid connecting hardware, straps, clips, braces, ties, and such securing devices. Inflation, deflation, and over pressure relief valves for deployment, recovery, pneumatic control, and positioning of independent and multiple guide segments are optionally attached to the external floatation vessel. The top center illustration is a profile view of a rigid guide segment. (1) The bottom center illustration is a profile view of a rigid guide segment (1) with an external floatation vessel (12) attached. The bottom illustration is a profile view of a variant of a rigid guide segment whereby the rigid guide segment or segments are of open configuration where elongated objects inserted into the guide assembly are predominantly exposed and visible being secured to the rigid guide segment or segments by guide bolts, pins, clamps, straps and such anchoring devices.

Referring to FIG. 5, the top illustration is a profile view of the optionally installed external floatation vessel (12) composed of rigid, solid, semisolid, hollow, static, flexible, or inflatable vessel materials for in-water floating assembly of the underwater guide assembly. The external floatation vessel is secured to the underwater guide segments by rigid connecting hardware, straps, clips, braces, ties, and such securing devices. Inflation, deflation, and over pressure relief valves for deployment, recovery, pneumatic control, and positioning of independent and multiple guide segments are optionally attached to the external floatation vessel. The top center illustration is a profile view of a rigid guide segment. (1) The bottom center illustration is a profile view of a rigid guide segment (1) with an external floatation vessel (12) attached. The bottom illustration is a profile view of a variant of a rigid guide segment whereby the rigid guide segment or segments are of open configuration where elongated objects inserted into the guide assembly are predominantly exposed and visible being secured to the rigid guide segment or segments by guide bolts, pins, clamps, straps and such anchoring devices.

Figure 6:
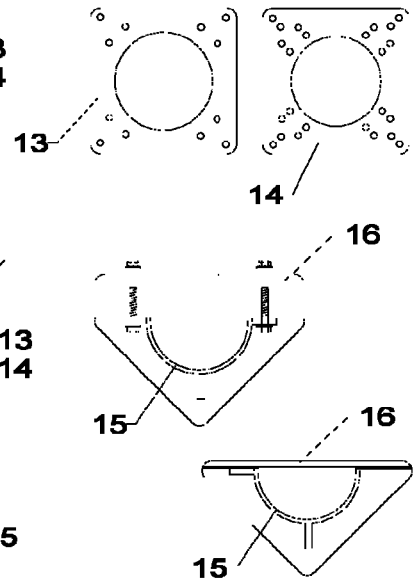
FIG. 6 is a general illustration matrix of the telescoping guide segments.

FIG. 6 is a general illustration matrix of the telescoping guide segments. The top left illustration is a plan view of a removable end flange plate (13) for a variant type of rigid guide segment whereby solid or slotted support rails (17), hollow support rails (18), and other rigid structural supports are connected to the end flange plates forming a rigid guide assembly. The top right illustration is a plan view of a removable end flange plate (14) for a variant type of an adjustable width rigid guide segment where adjustment in size is made by securing the support rails to alternate mounting holes or other slot positions and whereby solid or slotted support rails (17), hollow support rails (18), and other rigid structural supports are connected to the end flange plates forming a rigid guide assembly. The bottom left illustration is an end view of a variant open guide segment with a fixed, removable, or adjustable optionally installed end plate (15) for joining a plurality of segments together, and securing hardware (16) comprised of connecting containment hardware comprised of either straight, curved, or formed plates, bars, bolts, pins, straps, and such rigid and flexible materials used in conjunction with an open type variant of the rigid guide segment or segments. The bottom right illustration is an end view of a variant open guide segment (15) with the connecting containment hardware (16) secured.

Referring to FIG. 6, the top left illustration is a plan view of a removable end flange plate (13) for a variant type of rigid guide segment whereby solid or slotted support rails (17), hollow support rails (18), and other rigid structural supports are connected to the end flange plates forming a rigid guide assembly. The top right illustration is a plan view of a removable end flange plate (14) for a variant type of an adjustable width rigid guide segment where adjustment in size is made by securing the support rails to alternate mounting holes or other slot positions and whereby solid or slotted support rails (17), hollow support rails (18), and other rigid structural supports are connected to the end flange plates forming a rigid guide assembly. The bottom left illustration is an end view of a variant open guide segment with a fixed, removable, or adjustable optionally installed end plate (15) for joining a plurality of segments together, and securing hardware (16) comprised of connecting containment hardware comprised of either straight, curved, or formed plates, bars, bolts, pins, straps, and such rigid and flexible materials used in conjunction with an open type variant of the rigid guide segment or segments. The bottom right illustration is an end view of a variant open guide segment (15) with the connecting containment hardware (16) secured.

Figure 7:
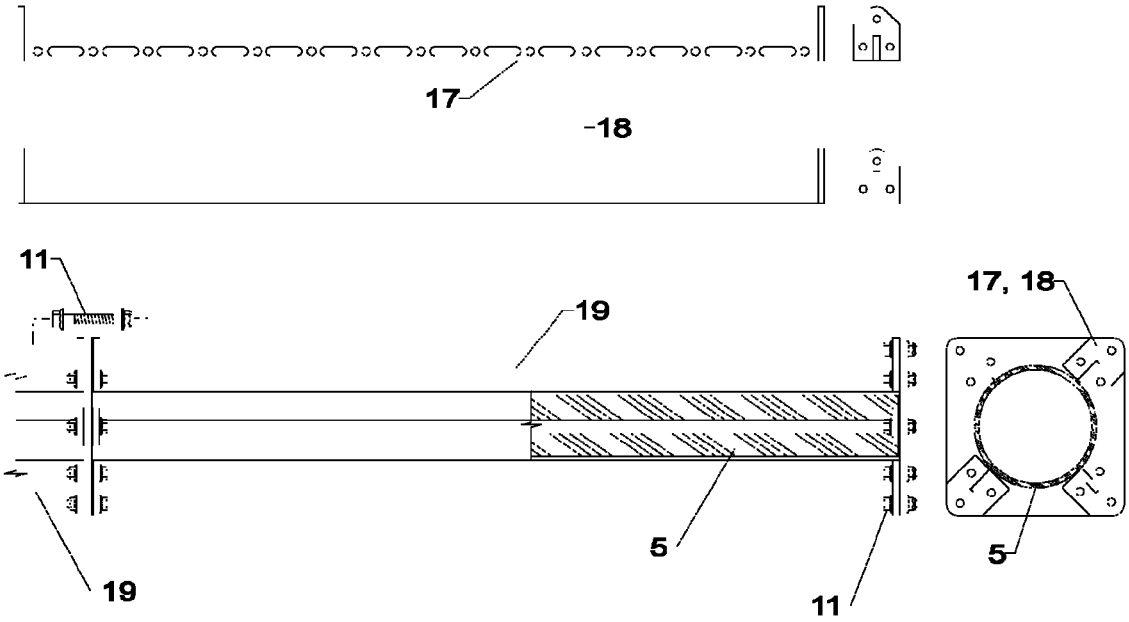
FIG. 7 is a general illustration matrix of the telescoping guide segments.

FIG. 7 is a general illustration matrix of the telescoping guide segments. The top and center illustrations are profile and end views of variant type rigid guide segments whereby a plurality of solid, slotted, or hollow support rails (17) and (18), and other rigid structural supports are connected to end flange plates (13) and (14) forming a rigid guide assembly. The bottom illustration is a profile and end view of an assembled variant guide segment with a plurality of removable support rails (17) and (18) and end flange plates (13) and (14) with an optionally installed inner-friction/spacer sleeve (5). The guide segments and variants thereof functions with or without the inner-friction/spacer sleeve (5).

Referring to FIG. 7, the top and center illustrations are profile and end views of variant type rigid guide segments whereby a plurality of solid, slotted, or hollow support rails (17) and (18), and other rigid structural supports are connected to end flange plates (13) and (14) forming a rigid guide assembly. The bottom illustration is a profile and end view of an assembled variant guide segment with a plurality of removable support rails (17) and (18) and end flange plates (13) and (14) with an optionally installed inner-friction/spacer sleeve (5). The guide segments and variants thereof functions with or without the inner-friction/spacer sleeve (5) with an optionally installed inner-friction/spacer sleeve (5).

Figure 8:
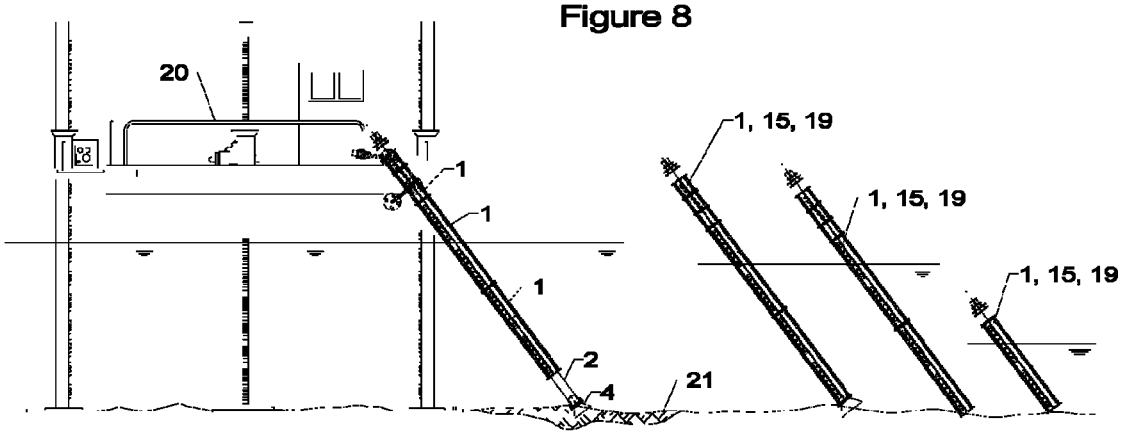
FIG. 8 is a profile view of a variant work surface.

FIG. 8 is a profile view of one variant work surface being a marine barge (20) as shown and a matrix of underwater guide assembly options. The illustration at the left shows the guide secured to the work surface or machinery. The guide configuration is comprised of three short length rigid guide segments, (1) one longer length rigid guide segment, (1) and one telescoping guide segment (1) and (2) with an angled, flare, cone end (4) resting on the bottom (21) of the body of water in a telescoping guide configuration. The illustration at left center shows the guide configuration comprised of three short length rigid guide segments, two longer length rigid guide segments, (1) (15) (19) and an angled, flare, cone end (4) attached to the end of the lower rigid guide segment (1) (15) (19) in a fixed length guide configuration resting on the bottom (21) of the body of water. The illustration at right center shows the guide configuration comprised of three short length rigid guide segments, (1) (15) (19) and two longer length rigid guide segments, (1) (15) (19) resting on the bottom (21) of the body of water in a fixed length guide configuration. The illustration at the right shows the guide configuration comprised of one longer length rigid guide segment, (1) (15) (19) resting on the bottom (21) of the body of water in a fixed length guide configuration.

Referring to FIG. 8, the guide configuration is comprised of three short length rigid guide segments, (1) one longer length rigid guide segment, (1) and one telescoping guide segment (1) and (2) with an angled, flare, cone end (4) resting on the bottom (21) of the body of water in a telescoping guide configuration. The illustration at left center shows the guide configuration comprised of three short length rigid guide segments, two longer length rigid guide segments, (1) (15) (19) and an angled, flare, cone end (4) attached to the end of the lower rigid guide segment (1) (15) (19) in a fixed length guide configuration resting on the bottom (21) of the body of water. The illustration at right center shows the guide configuration comprised of three short length rigid guide segments, (1) (15) (19) and two longer length rigid guide segments, (1) (15) (19) resting on the bottom (21) of the body of water in a fixed length guide configuration. The illustration at the right shows the guide configuration comprised of one longer length rigid guide segment, (1) (15) (19) resting on the bottom (21) of the body of water in a fixed length guide configuration.

In the configuration of FIG. 8, the guide is positioned at a 55 degree angle, with respect to the surface of the bed. In other words, the guide and a normal to bed define an angle of 35 degrees. The guide in FIG. 8 has a length of 34' and, because of the angle, a 16' lateral reach.

Winch 25 acts to change the angle position of the guide.

FIG. 9 is a profile view of one variant work surface being a marine barge (20) as shown and a matrix of underwater guide assembly options. The illustration at the left shows the guide secured to the work surface or machinery. The guide configuration is comprised of five short length rigid guide segments, (1) one longer length rigid guide segment, (1) one flangeless telescoping section (3) for optional intermediate or end extension of rigid guide segments, and one telescoping guide segment (1) and (2) with an angled, flare, cone end (4) resting on the bottom (21) of the body of water in a telescoping guide configuration. The illustration at right shows a variant of the guide configuration comprised of two open frame half section longer length rigid guide segments, (1) (15) (19) whereby the rigid guide segment or segments and optionally attached angled, flare, cone end (4) are of open configuration where elongated objects inserted into the guide assembly are predominantly exposed and visible, resting on the bottom (21) of the body of water in a fixed length guide configuration.

Referring to FIG. 9, the guide configuration is comprised of five short length rigid guide segments, (1) one longer length rigid guide segment, (1) one flangeless telescoping section (3) for optional intermediate or end extension of rigid guide segments, and one telescoping guide segment (1) and (2) with an angled, flare, cone end (4) resting on the bottom (21) of the body of water in a telescoping guide configuration. The illustration at right shows a variant of the guide configuration comprised of two open frame half section longer length rigid guide segments, (1) (15) (19) whereby the rigid guide segment or segments and optionally attached angled, flare, cone end (4) are of open configuration where elongated objects inserted into the guide assembly are predominantly exposed and visible, resting on the bottom (21) of the body of water in a fixed length guide configuration.

In the configuration of FIG. 9, the guide is positioned at a 35 degree angle, with respect to the surface of the bed. In other words, the guide and a normal to bed define an angle of 55 degrees. The guide in FIG. 9 has a length of 44' and, because of the angle, a 40' lateral reach.

Figure 10:
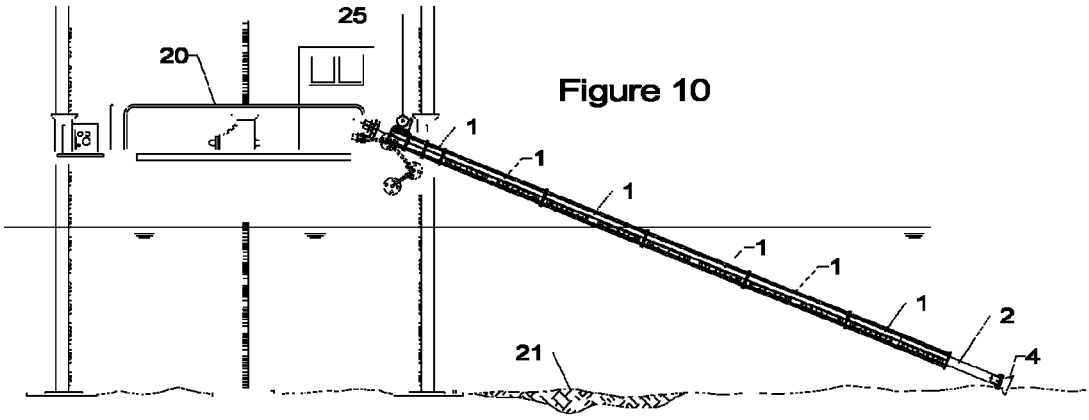
FIG. 10 is a profile view of a variant work surface.

FIG. 10 is a profile view of one variant work surface being a marine barge (20) as shown and a matrix of underwater guide assembly options. The illustration shows the guide secured to the work surface or machinery. The guide configuration is comprised of three short length rigid guide segments, (1) four longer length rigid guide segments, and one telescoping guide segment (1) and (2) with an angled, flare, cone end (4) resting on the bottom (21) of the body of water in a telescoping guide configuration.

Referring to FIG. 10, the guide configuration is comprised of three short length rigid guide segments, (1) four longer length rigid guide segments, and one telescoping guide segment (1) and (2) with an angled, flare, cone end (4) resting on the bottom (21) of the body of water in a telescoping guide configuration.

In the configuration of FIG. 10, the guide is positioned at a 20 degree angle, with respect to the surface of the bed. In other words, the guide and a normal to bed define an angle of 70 degrees. The guide in FIG. 10 has a length of 72' and, because of the angle, a 60' lateral reach.

The above-described embodiments provide for an underwater guiding apparatus comprising independent rigid segments and independent telescoping segments assembly of one or more sectional segments wherein one or more tubing, open frame segments are static and one or more segments are movable being of different dimension than the static segments with a means for coupling the segments wherein the means permits the segmental extension and retraction of the telescoping segment assembly and a means for varying the length of the underwater guiding apparatus by adding and removing rigid or telescoping segments thereby extending and retracting the assembly with a combination of rigid segments and telescoping segments for guiding, containment, direction, penetration, placement, and installation, of elongated structures such as directional, variable angle machine, bore, drill, equipment, materials and such elongated structures such as stems, rods, piping, tubing, hoses, cables, lines and other similar structures through the atmosphere, vacuum, partial vacuum, fluid, fluid and water columns in man made containment vessels, artificial and natural bodies of water such as lakes, streams, rivers, coastal waters, oceans and into and through such waterway and other bottom materials and without environmental impact, and other applications with the following distinct features and advantages.

1. It provides for guiding, direction, penetration, placement, and installation, of elongated structures such as directional, variable angle machine, bore, drill, equipment, material and such elongated structures such as stems, rods, piping, tubing, hoses, cables, lines and other similar structures through the atmosphere, vacuum, partial vacuum, fluid, fluid and water columns in man made containment vessels, artificial and natural bodies of water such as lakes, streams, rivers, coastal waters, oceans and into and through such waterway and other bottom materials and without environmental impact at variable segmented and assembly lengths and angles by creating an infinitely adjustable angle, length, diameter, dimension, width, dynamic and statically controlling segmental and telescoping guide segments thereby adjusting its length and angle from end to end.

2. It is infinitely adjustable in length. It can be adjusted to any length within its operational limits for use in atmosphere, vacuum, partial vacuum, fluid, fluid and water columns in man made containment vessels, artificial and natural bodies of water such as lakes, streams, rivers, coastal waters, oceans and into and through such waterway and other bottom materials.

3. It is infinitely adjustable in orientation and angle of installation. It can be adjusted to any angle within its operational limits for use in atmosphere, vacuum, partial vacuum, fluid, fluid and water columns in man made containment vessels, artificial and natural bodies of water such as lakes, streams, rivers, coastal waters, oceans and into and through such waterway and other bottom materials.

4. It can be incrementally sized in segmented or overall diameter, dimension, and width to accommodate a variety of elongated structures and guide components for various directional, variable angle machine, bore, drill, stems, rods, piping, tubing, hoses, cables, lines equipment, materials and other such elongated structures.

5. It permits variable configuration of primary and supportive guide components such as tubes, brackets, rails, beams, frames, clamps, through hole plates, trusses, and standoffs.

6. It permits variable configuration of the guide support rails and longitudinal support members such as number, shape, and configuration of rails along with a variety of rail materials such as solid, angular, box, and tubular materials which can be drilled, slotted, and machined to accommodate various features, options, equipment, capabilities and attachment points.

7. It permits independent and combined sectional and telescoping guide configuration using solid wall tubing, drilled or slotted tubing, rings, beams, support rails, trusses, frames and angular or box materials.

8. It permits variable configuration of the telescoping segments such as locking, sectional, and telescoping extension and retraction mechanisms such as dynamic friction and static lock down screws, pressure screws, travel limitation screws, springs, bolts, pins, bolts, and control linkage.

9. It permits variable mounting and attachment of individual and multi-segment end segments such as angled, flare, bell, and cone ends by bolting, sliding, clamping, clipping, machine fitting or being fixed as well as variable configurations in angle, length, diameter, curved, solid wall, slotted, banded, caged, rigid or flexible.

10. Once installed, it can function statically thereby fixing its overall length.

11. Once installed, it can function dynamically thereby self adjusting its length for varying distances in atmosphere, fluid, fluid and water columns in man made containment vessels, artificial and natural bodies of water such as lakes, streams, rivers, coastal waters, oceans and dynamic changes in end to end clear dimension due to movement including but not limited to such movements from wind, wave action, tides, changes in work surface elevation, external mechanical, natural forces and other factors.

12. Once installed, it can function both statically and dynamically thereby partially and segmentally fixing its overall length while partially and segmentally adjusting its length for varying water column depths and changes in end to end clear dimension due to movement including but not limited to such movements from wind, wave action, tides, changes in work surface elevation, external mechanical, natural forces and other factors.

13. It is self deploying. Attaching support equipment and machinery to base plate(s) secured anywhere along its length such as equipment to assist in handling, setup, deployment, adding and removing segments, extension, retraction, recovery, breakdown, and storage of the guide components as well as support equipment and machinery for handling, manipulation and recovery of elongated structures.

14. Each guide segment is rigid thereby providing lateral support for elongated structures while reducing overall deflection using single or multiple guide segments.

15. It can be manufactured from a variety of materials such as aluminum, steel, alloys, composites, and plastics.

16. It can be universally mounted to a variety of fixed, land based, suspended, marine, aerospace, and movable construction, mechanical, and scientific type equipment.

17. It is dynamic and can be used from fixed or movable locations of varying water column depths and changes in end to end clear dimension due to movement including but not limited to such movements from wind, wave action, tides, changes in work surface elevation, external mechanical, natural forces and other factors.

18. It is fully adjustable and expandable in length, diameter, width, dimension, and operational capabilities by adding and removing guide segments and components to increase its scope and range of operation.

19. It is simple. It has no mechanical moving parts.

20. It is portable. Each rigid guide segment can be sized in as desired in length, width, and dimension and can be completely or partially dismantled, and easily transported in a small vehicle, and operates with no moving parts.

21. It is light weight. Each of its accordingly sized segments, components can be lifted and transported by hand, and operates with no moving parts.

22. The exemplary embodiment provides a professional and aesthetic appearance with functional performance. The optionally drilled and slotted support rails and beams reduce overall deflection, reduce weight and provide numerous connection points along their full length. The optional external box support rails provide lateral support for the inner guide components while providing internal integrated floatation control for individual and multiple guide segments.

23. Guide components can be easily assembled, used, and dissembled in-water close to the water surface using the externally or integrated floatation vessels providing floatation control for individual and multiple guide segments.

24. The segment end components such as angled, bell, flair, cone assists in self alignment, docking and recovery of installed elongated structures and associated installation machinery and equipment.

25. The optionally installed floatation vessels permits infinite operational floatation and buoyancy adjustment and control for individual and multiple guide segments.

26. The guide segments and assembly provides a means for guiding, handling, direction, penetration, placement, and installation, of elongated structures through the atmosphere, vacuum, partial vacuum, fluid, fluid and water columns in man made containment vessels, artificial and natural bodies of water such as lakes, streams, rivers, coastal waters, oceans and into and through such waterway and other bottom materials without environmental impact.

27. The above advantages and uses may be employed in any area of application limited only by the imagination of the user. For example, in underwater applications, the method of the exemplary embodiment may be employed in the following environments and applications.

1. Underwater, Above Water, Fluids.
2. Semi-submerged.
3. Aerospace.
4. Containment Vessels, Tanks, and Containers.
5. Disposal Facilities
6. Installation of power and other cables and lines.
7. Installation of fiber optic and other type communications cables.
8. Installation of utility and other lines and conduits.
9. Installation of pipelines.
10. Installation of navigation lighting and related systems.
11. Installation of anchoring cables and similar structures.
12. Bottom and sub-bottom material sampling.
13. Probing, Remote testing.
14. Installation of sub-bottom sensors.
15. Installation of sub-bottom instrumentation.

In summary, The exemplary embodiment is an underwater guiding apparatus comprising independent rigid segments and independent telescoping segments assembly of one or more sectional segments wherein one or more tubing, open frame segments are static and one or more segments are movable being of different dimension than the static segments with a means for coupling the segments wherein the means permits the segmental extension and retraction of the telescoping segment assembly and a means for varying the length of the underwater guiding apparatus by adding and removing rigid or telescoping segments thereby extending and retracting the assembly with a combination of rigid segments and telescoping segments.

The underwater guiding apparatus comprises a means for locking the telescoping assembly in fixed length configurations and further comprises a means for adjusting the angle of the guiding apparatus.

The underwater guiding apparatus comprises a segment for anchoring and securing the underwater guiding apparatus to a fixed or variable elevation work surface, mechanical equipment and machinery. The underwater guiding apparatus comprises rigid fixed length segments and telescoping segment or segments in an assembly wherein the telescoping segment assembly comprises an outer segment, an inner extension segment, and an angular, flare, cone end, wherein the inner extension segment is slidably engaged with the outer segment to permit extension and retraction of the inner extension segment, the end being secured to one end of the inner extension segment.

The underwater guiding apparatus wherein the telescoping segment assembly further comprises one or more binding blocks with set screws and pins for locking the inner extension segment in a fixed position. The underwater guiding apparatus wherein one or more telescoping segment assemblies comprises an inner extension segment of differing dimension being positioned between the rigid outer receiver segments to permit both segmental extension and extension and retraction of the telescoping segment assembly.

The underwater guiding apparatus wherein the angled, flare, cone end is secured to the end of a rigid segment or end of an inner telescoping segment of the telescoping assembly being temporarily secured by connecting hardware or permanently secured by welding the end section to the inner telescoping segment assembly.

The underwater guiding apparatus wherein one or more of the segments of the telescoping segments are comprised of a plurality of bars, connecting hardware, or guides in a cylindrical or angular pattern and a friction sleeve positioned within and secured by the bars connecting hardware, or guides.

The underwater guiding apparatus bars are constructed containing airtight cavities thereby enabling the pipe to function as a floatation vessel. The underwater guiding apparatus wherein one or more of the components of the telescoping assembly further comprise integrated or attached flotation vessels.

The underwater guiding apparatus is constructed containing a completely or partially enclosed containment cavity or channel and a single or plurality of lateral containment tubes, channels, pins, and connecting hardware thereby providing the elongated objects such as directional, variable angle drill, bore and such machine and other stems, rods, piping, tubing, hoses, cables, lines and other similar elongated rigid and flexible structures with lateral support.

The underwater guiding apparatus wherein one or more of the components of the fixed length segments and telescoping segments further comprise integrated or attached flotation vessels.

The underwater guiding apparatus enables a method of guiding underwater submerged elongated structures through varying water column depths comprising the steps of: selecting a single or plurality of rigid fixed length segments and installing the assembly at a desired work angle and if desired, connecting one or a plurality of telescopic segments to the fixed length segment or segments and positioning the underwater guiding apparatus in the area and location where the elongated structures are to be guided and orienting the assembly to the desired angle and extension length.

The method for guiding underwater submerged elongated structures wherein the elongated rigid and flexible structures are one or more of stems, rods, piping, tubing, hoses, cables, and lines. The method for guiding underwater submerged elongated structures wherein the guiding is performed for the placement and installation of both rigid and flexible elongated structures. The method for guiding underwater submerged elongated structures further comprises the step of securing the assembly to a fixed or variable elevation work surface, machinery and equipment.

In other words, there is a system for positioning elongated structures such as piping, hoses, cables, wires, tubing, and such elongated structures on or below the bottom of the water columns, bodies of water such as lakes, streams, rivers, coastal waters, oceans, and fluids comprising; an underwater guiding apparatus; the underwater guiding apparatus comprising an assembly of a single and/or plurality of elongated fixed, telescopic, or combination of fixed and telescopic segments with no moving parts; each of the segments to contain, enclose, and guide the piping, hoses, cables, wires, tubing, and such elongated structures within each single or plurality of the segments; at least one of the segments individually or connected to at least one other adjacent segment by static, telescoping, or combination of static and telescoping coupling means; each the coupling means configured to permit static, and/or telescopic extension, or retraction of the adjacent segments; one or a plurality of the segments configured to be independent and/or permit the addition of one or more segments in static, telescoping, or combination of segmented fixed and telescoping relationship; at least one of the segments configured for removal from the plurality of remaining segments;

The underwater guiding apparatus further comprises means for securing and/or locking the assembly of a single or plurality of segments in a fixed, telescopic, and/or combination of fixed and telescopic segments; a work surface positioned on, above, or adjacent to a body of water and/or atmosphere; the underwater guiding apparatus secured to the work surface proximate a first end of the underwater apparatus; the underwater guiding apparatus longitudinally and angularly adjustable relative to the work surface; and at least a portion of the underwater guiding apparatus located below the surface of the water or fluid proximate a second end, in a position to guide the drills, stems, rods, piping, tubing, hoses, cables, lines equipment, materials and other such elongated structures through the guiding apparatus onto and/or under the bottom of the body of water and/or other surface atmospheric surface materials.

The guiding apparatus further comprises a means for securing or locking the fixed length segments and telescoping segments and assembly in a fixed length configuration.

The guiding apparatus further comprises a means for adjusting the angle of the fixed length segments, telescoping segments and assembly.

The guiding apparatus further comprises a segment for securing or anchoring the guiding apparatus to a fixed, movable, or variable elevation work surface.

According to an alternate embodiment, a guiding apparatus comprises: a segmented and optionally telescoping assembly; not limited to two segments for guiding elongated structures through the apparatus wherein the segmented assembly comprises a single or plurality of rigid independent segments optionally incorporating a telescoping segment within the assembly which comprises a rigid guide segment, telescoping extension segment, and an angled, flare, cone end, wherein the telescoping segment is slidably engaged with receiver segment to permit extension and retraction of the telescoping segment and guide assembly.

The alternate guiding apparatus further comprises an optionally installed base plate or plurality of base plates attached to rigid or telescoping segments for securing hardware and machinery.

The alternate guiding apparatus further comprises a rigid segment to the telescoping assembly for attaching the guiding apparatus to a fixed, movable, or variable elevation work surface, machinery or equipment.

In the alternate guiding apparatus, the sectional assembly further comprises an independent rigid segment coupled to additional rigid segments or to the telescoping segment of the sectional or telescoping assembly.

In the alternate guiding apparatus, the telescoping segment and assembly further comprises one or more binding blocks with securing hardware for locking the telescoping segment and assembly in a fixed position.

In the alternate guiding apparatus, the telescoping assembly further comprises one or more additional telescoping segments of differing dimension than the rigid guide segment positioned between the rigid guide segment the angled, flare, cone end to permit increased extension length.

In the alternate guiding apparatus, the angled, flare, cone end is secured to the fixed guide segment, telescoping segment, and assembly by being bolted, clipped, pinned or welded on to the end of a fixed guide segment or telescoping segment.

The alternate guiding apparatus further comprises a means for adjusting the angle of the fixed length or telescoping assembly. The means for adjusting the angle of may be by hand, floatation vessels, or by attached equipment or machinery.

In the alternate guiding apparatus, one or more of the segments of the rigid and telescoping assembly are comprised of a single or plurality of solid, enclosed, openly constrained, and/or hollow lateral supports in a substantially cylindrical and/or angular pattern and an optional inner-friction or spacer sleeve contained and positioned within the guide segments.

In the alternate guiding apparatus, the securing hardware are constructed containing cavities thereby enabling the guide segment lateral supports to function as a floatation vessel for the guide segments.

In the alternate guiding apparatus, one or more of the components of the guide segments and telescoping assembly further comprise externally attached or integrated flotation vessels with no moving parts.

There is an exemplary process and method for guiding elongated structures such as drills, stems, rods, piping, hoses, cables, wires, tubing, and such elongated structures through water columns, man made containment vessels, artificial and natural bodies of water such as lakes, streams, rivers, coastal waters, oceans, and the atmosphere with no moving parts comprising the steps of: providing a guiding apparatus; the guiding apparatus an assembly of a plurality of elongated segments; each of the segments to contain, enclose, and guide the stems, piping, hoses, cables, wires, tubing, and such elongated structures within the segments without moving parts; at least one of the segments individually or connected to at least one other adjacent segment by static, telescoping, or combination of static and telescoping coupling means without moving parts; each the coupling means configured to permit fixed, telescopic, and/or combination of fixed and telescopic extension and/or retraction of the adjacent segments; at least one or more of the segments configured to permit addition of one or more segments in fixed, telescopic, or a combination of fixed and telescopic relationship with no moving parts; at least one of the segments configured for removal from the remaining segments; the guiding apparatus further comprising means for securing and/or locking the assembly of one or more segments in a fixed, telescopic, or combination fixed and telescopic relationship; securing one or more segments to a fixed, movable, or variable elevation work surface, so that the assembly of a plurality of segments is longitudinally and angularly adjustable; orienting the assembly of a plurality of segments to a desired angle, overall length, or an extension and retraction range; positioning at least part of the guiding apparatus through water columns, man made containment vessels, artificial and natural bodies of water such as lakes, streams, rivers, coastal waters, oceans, and the atmosphere; and positioning and moving the elongated structures such as piping, hoses, cables, wires, tubing, and such elongated structures through a segment or plurality of segments into position on or below the bottom of the water columns, bodies of water such as lakes, streams, rivers, coastal waters, oceans, and fluids.

In the exemplary method, the elongated structure is one of stems, rods, piping, tubing, hoses, cables, and lines without moving parts.

In the exemplary method, the guiding is performed for the placement and installation of the elongated structures without moving parts.

The method for guiding elongated structures further comprises the step of securing a guide segment to a fixed, movable, or variable elevation work surface, machinery or equipment without moving parts.

Thus, an underwater guiding device includes one or combination of a plurality of rigid guide segments, and/or telescoping guide segments where one or plurality of segments are of fixed length and one or plurality of segments are telescoping permitting use of either a single segment, a plurality of rigid guide segments for incremental extension of the assembly, and a combination of rigid guide segments and a telescoping guide segment or segments for sectional, infinitely adjusted, and dynamic extension and retraction of the guide assembly. The assembly can be secured to a stationary or moving work surface with static or dynamic control of individual segments, multiple guide segments, and assembly. The guide can be adjusted to any length and for any angle of operation. The guide is a method for guiding underwater submerged elongated structures through the water column into and through marine and other bottom surface, and subsurface materials.

Benefits, other advantages, and solutions to problems have been described above with regard to specific examples. The benefits, advantages, solutions to problems, and any element (s) that may cause any benefit, advantage, or solution to occur or become more pronounced are not critical, required, or essential feature or element of any of the claims.

Additional advantages and modifications will readily occur to those skilled in the art. The invention in its broader aspects is therefore not limited to the specific details, representative apparatus, and illustrative examples shown and described. Accordingly, departures may be made from such details without departing from the spirit or the scope of Applicants' general inventive concept. The invention is defined in the following claims. In general, the words "first," "second," etc., employed in the claims do not necessarily denote an order.

The invention claimed is:

1. A method for drilling in an environment having a fluid and a bed, the method comprising:

positioning a platform such that the fluid is between the platform and the bed;

assembling a guide, the assembled guide being straight;

placing the guide such that the guide is supported by the platform and supported by the bed, and a major length of the guide and a normal to the bed defines an angle, the angle being greater than 0;

changing the angle defined by the major length of the guide and the normal to the bed; and sending a variable angle drill inside the guide, from the platform into the bed at a time when the guide is supported by the platform and supported by the bed.

2. The method of claim 1 wherein the angle defined by the major length of the guide and the normal to the bed is at least 35 degrees.

3. The method of claim 1 wherein assembling the guide includes coupling a first longitudinal section to a second longitudinal section.

4. The method of claim 3 further including adjusting the major length of the guide, by adjusting the first longitudinal section relative to the second longintudinal section.

5. The method of claim 4 further including fixing the relative position with a screw.

6. The method of claim 4 further including fixing the relative position with a pin.

7. The method of claim 4 further including fixing the relative position with a block.

8. The method of claim 3 wherein the second longitudinal section fits within the first longitudinal section.

9. The method of claim 3 wherein the second longitudinal section defines a tube shape.

10. The method of claim 3 wherein assembling the guide includes assembling the guide to have a cone-shaped end, and positioning includes positioning such that the cone-shaped end is the distal end.

11. The method of claim 3 wherein assembling the guide includes coupling a third member that moves during operation of the guide.

12. The method of claim 3 wherein the first longitudinal section defines a cavity enabling the first longitudinal section to function as a floatation vessel.

13. The method of claim 1 further including using a winch to change the angle defined by the major length of the guide and the normal to the bed.

14. The method of claim 1 wherein the major length of the guide is at least 34 feet.

15. A method for drilling in an environment having a fluid and a bed, the method comprising:

positioning a support such that the fluid is between the support and the bed;

assembling a guide, the assembled guide being straight;

placing the guide such that the guide is supported by the support and supported by the bed, and a major length of the guide and a normal to the bed defines an angle, the angle being greater than 0;

changing the angle defined by the major length of the guide and the normal to the bed; and sending a variable angle drill inside the guide, from the support into the bed at a time when the guide is supported by the platform and supported by the bed.

16. The method of claim 15 wherein the changing step includes using a winch to change the angle.

17. A method for drilling in an environment having a fluid and a bed, the method comprising:

positioning a platform such that the fluid is between the platform and the bed;

assembling a guide, the assembled guide being straight;

placing the guide such that the guide is supported by the platform, and a major length of the guide and a normal to the bed defines an angle, the angle being greater than 0;

sending a variable angle drill inside the guide, from the platform into the bed, wherein assembling the guide includes coupling a first longitudinal section to a second longitudinal section, and the method further includes adjusting the major length of the guide, by adjusting the first longitudinal section relative to the second longitudinal section; and fixing the relative position with a screw.

18. A method for drilling in an environment having a fluid and a bed, the method comprising:

positioning a platform such that the fluid is between the platform and the bed;

assembling a guide, the assembled guide being straight;

placing the guide such that the guide is supported by the platform, and a major length of the guide and a normal to the bed defines an angle, the angle being greater than 0;

sending a variable angle drill inside the guide, from the platform into the bed, wherein assembling the guide includes coupling a first longitudinal section to a second longitudinal section, and the method further includes adjusting the major length of the guide, by adjusting the first longitudinal section relative to the second longitudinal section; and fixing the relative position with a pin.

19. A method for drilling in an environment having a fluid and a bed, the method comprising:

positioning a platform such that the fluid is between the platform and the bed;

assembling a guide, the assembled guide being straight;

placing the guide such that the guide is supported by the platform, and a major length of the guide and a normal to the bed defines an angle, the angle being greater than 0;

sending a variable angle drill inside the guide, from the platform into the bed, wherein assembling the guide includes coupling a first longitudinal section to a second longitudinal section, and the method further includes adjusting the major length of the guide, by adjusting the first longitudinal section relative to the second longitudinal section; and fixing the relative position with a block.

20. A method for drilling in an environment having a fluid and a bed, the method comprising:

positioning a platform such that the fluid is between the platform and the bed;

assembling a guide, the assembled guide being straight and defining a first opening at a first end and a second opening at a second end;

placing the guide such that the guide is supported by the platform and supported by the bed, and a major length of the guide and a normal to the bed defines an angle, the angle being greater than 0;

changing the angle defined by the major length of the guide and the normal to the bed; and sending a variable angle drill inside the guide, from the platform, through the second opening, into the bed at a time when the guide is supported by the platform and supported by the bed and a portion of the second opening is above the bed.

* * * * *